US005622502A

United States Patent [19]

Wilkes et al.

[11] Patent Number: 5,622,502

[45] Date of Patent: Apr. 22, 1997

[54] TOOTH BRUSH WITH HELICAL BRISTLES AND METHOD

[76] Inventors: David B. Wilkes; Lucille Wilkes, both of 3101 East, 3300 North, Twin Falls, Id. 83301

[21] Appl. No.: 343,624

[22] Filed: Nov. 22, 1994

[51] Int. Cl.[6] ..... A61C 17/00; A46B 9/04

[52] U.S. Cl. ..... 433/216; 15/167.1; 15/195; 15/190; D4/104; D4/112

[58] Field of Search ..... 15/159.1, 160, 15/167.1, 190, 195, 205; 433/216; D4/104, 112

[56] References Cited

U.S. PATENT DOCUMENTS

| | | | |
|---|---|---|---|
| D. 240,095 | 6/1976 | Sims . | |
| D. 279,049 | 6/1985 | Putkonen | D4/106 |
| D. 315,450 | 3/1991 | Wagner | D4/106 |
| D. 318,760 | 8/1991 | Kreisher et al. | D4/104 |
| D. 321,092 | 10/1991 | Woll et al. | D4/106 |
| D. 321,287 | 11/1991 | Woll et al. | D4/106 |
| D. 324,310 | 3/1992 | Barman | D4/104 |
| D. 334,288 | 3/1993 | Witzig-Jaggi | D4/104 |
| D. 334,473 | 4/1993 | Volpenhein et al. | D4/104 |
| D. 337,660 | 7/1993 | Ricciarelli et al. | D4/138 |
| 860,435 | 7/1907 | Bangs | 15/167.1 |
| 876,185 | 1/1908 | Hillman | 15/167.1 |
| 1,805,587 | 5/1931 | Manley | 15/167.1 |
| 1,813,076 | 7/1931 | Newell | 15/167.1 |
| 2,130,244 | 9/1938 | Nishio | 15/190 |
| 2,276,889 | 3/1942 | Stark . | |
| 2,343,782 | 3/1944 | Lotters | 15/160 |
| 2,358,464 | 9/1944 | Mayer | 15/190 |
| 2,409,490 | 10/1946 | Jobst | 15/195 |
| 2,688,790 | 9/1954 | Corbett . | |
| 2,807,820 | 10/1957 | Dinhofer . | |
| 2,882,544 | 4/1959 | Hadidian | 15/167.1 |
| 3,082,457 | 3/1963 | Lucibello et al. | 15/167.1 |
| 3,425,084 | 2/1969 | St. Laurence et al. | 15/195 |
| 3,527,218 | 9/1970 | Westine . | |
| 4,185,349 | 1/1980 | Papas | 15/106 |
| 4,291,432 | 9/1981 | Cogswell | 15/160 |
| 4,524,478 | 6/1985 | Ross | 15/167.1 |
| 4,575,894 | 3/1986 | Stevens et al. | 15/172 |
| 4,694,844 | 9/1987 | Burl et al. . | |
| 4,876,157 | 10/1989 | Barman | 428/542.8 |
| 4,972,542 | 11/1990 | Moshos et al. | 15/167.2 |
| 5,175,901 | 1/1993 | Rabinowitz | 15/167.2 |
| 5,228,466 | 7/1993 | Klinkhammer | 132/308 |
| 5,269,038 | 12/1993 | Bradley | 15/167.1 |

FOREIGN PATENT DOCUMENTS

| | | | |
|---|---|---|---|
| 215707 | 11/1924 | United Kingdom | 15/190 |

*Primary Examiner*—Mark Spisich

*Attorney, Agent, or Firm*—John J. Connors; Connors & Assoc.

[57] ABSTRACT

A tooth brush 10 includes a handle 12 having at one end a head 14 to which bristles are attached. A substantial number of these bristles have ends which terminate at a surface that has a helical shape.

11 Claims, 4 Drawing Sheets

FIG. 7a
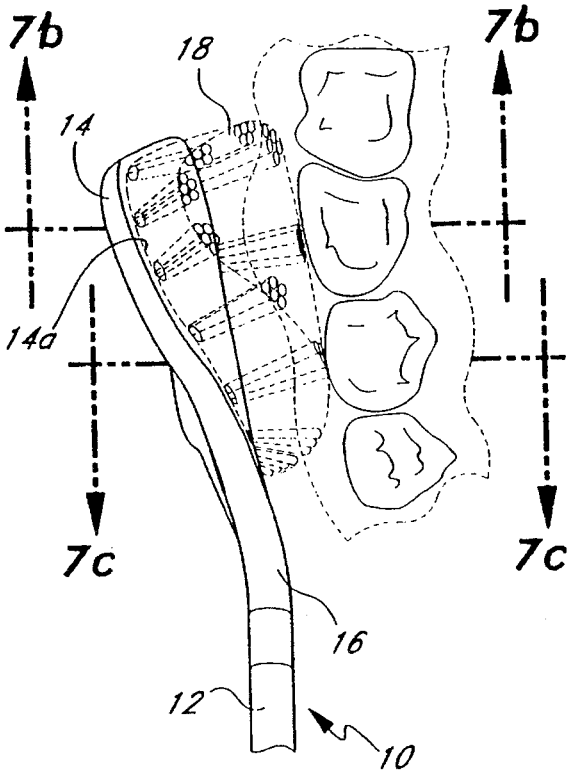
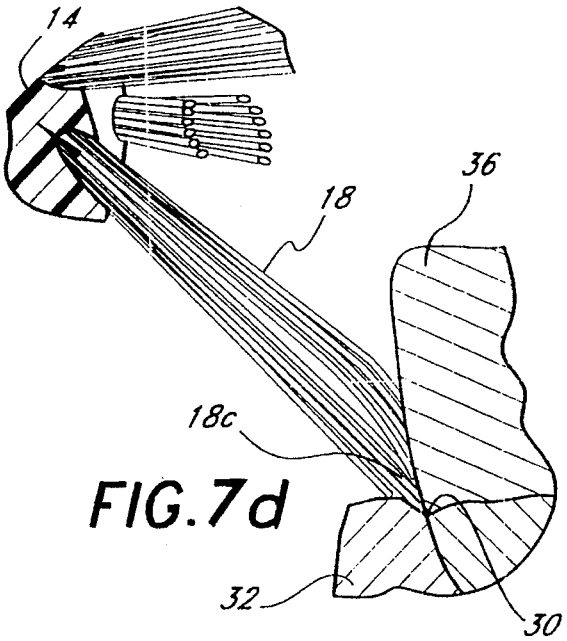
FIG. 7d
FIG. 7b
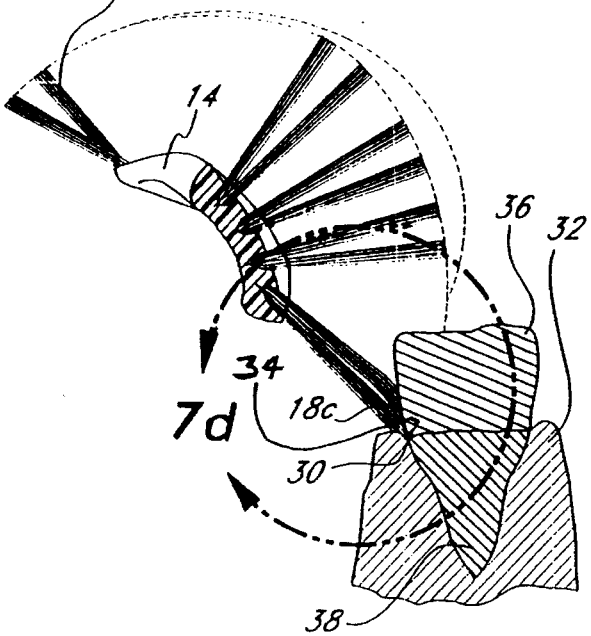
FIG. 7c
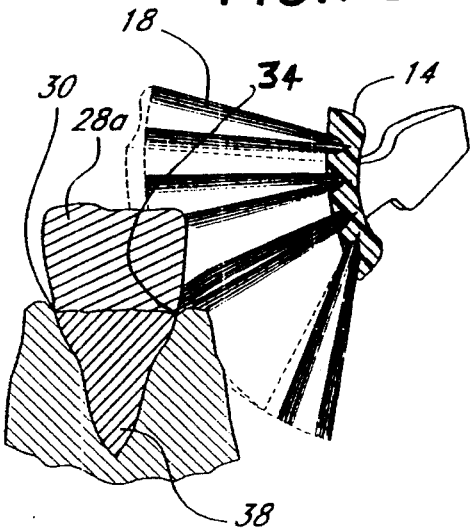

FIG. 8a
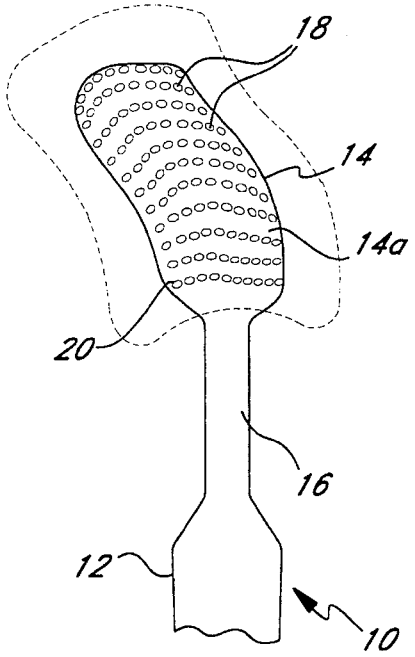
FIG. 8b
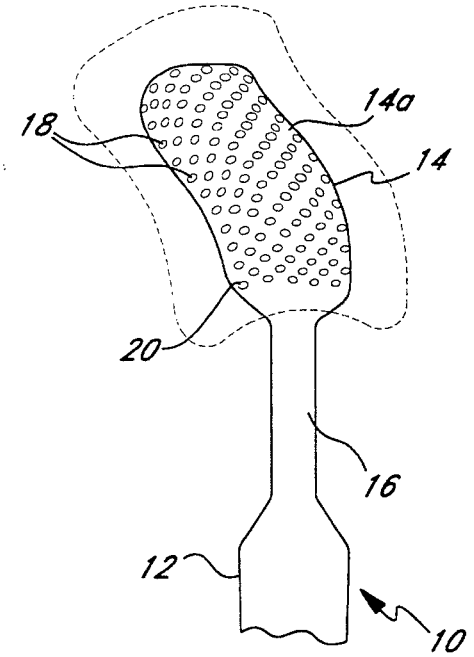
FIG. 8c
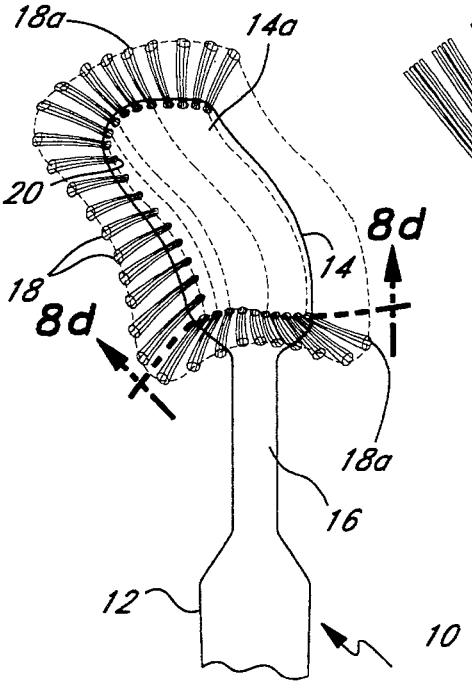
FIG. 8d
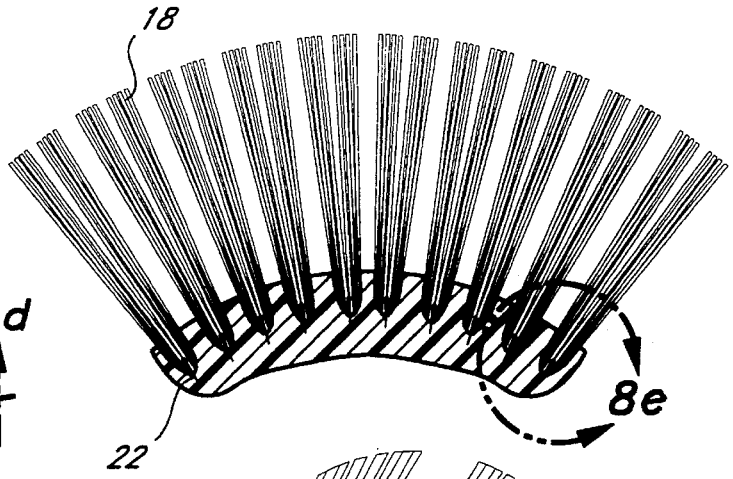
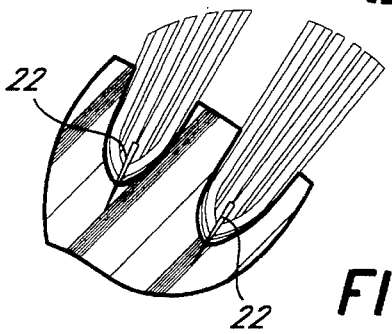
FIG. 8e

TOOTH BRUSH WITH HELICAL BRISTLES AND METHOD

BACKGROUND OF THE INVENTION

1. Field of the Invention

This invention relates to a tooth brush that has a uniquely shaped head that orients the brush's bristles in a fashion that ensures that a large number of the bristles make the preferred angular contact of about 45° with the side of the user's teeth during brushing.

2. Background Discussion

Tooth brushes are normally designed to include a handle with a head at one end which carries bristles that project outward from one side of the head. The bristles typically comprise bundles of monofilaments. In one conventional tooth brush design, these monofilament bundles are bent at their midpoint and stapled into position on the head of the tooth brush. Usually, a metal staple is used which is embedded deep within a recess in the head of the tooth brush. Because the monofilaments are bent at their midpoint, there are two bristles per monofilament of about equal length, although all the bristles do not have to be of the same length. These bristles are normally all aligned in a single direction and are generally parallel to one another.

Although this arrangement of bristles is widely used, many of the bristles do not make the preferred angular contact of about 45° with the teeth during bushing. In other words, when the user manipulates the tooth brush, rubbing the bristles across his or her teeth, frequently most, if not all, of the bristles are at an angle of substantially less than 45° or substantially more than 45°. This angular relationship is desired in order for the tips of the individual bristles to rub against the sulcas, the marginal zone between the base of a tooth and the gum line. Ideally, the tips of the bristles fit into this zone and remove food and plaque from this zone during brushing.

SUMMARY OF THE INVENTION

It is the objective of this invention to provide a tooth brush with its bristles arranged so that during brushing a large number of the bristles are always at an angle of about 45° with respect to the user's teeth, particular at the sulcas, regardless of the manner in which the user holds or turns the tooth brush during brushing.

The tooth brush of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include more effective bushing of teeth at the dentist recommended contact angle of 45°.

The first feature of the tooth brush of this invention is that it includes a handle having at one end a head to which bristles are attached, a substantial number of these bristles having ends which terminate at a surface that has a helical shape. The head typically has a generally rectangular configuration which is twisted into a generally helical shape. This head has one side from which bundles of bristles extend. The bristles of an individual bundle may diverge outward from the base of the bundle or all be generally parallel. Preferably, the bristles only extend from this one side of the head. Most, if not all, of the bristles preferably have approximately the same length and terminate in ends which lie in the helical shaped surface.

The second feature is that there typically are more bundles of bristles than in conventional tooth brushes. Preferably, there are from about 100 to about 250 bristle bundles in the head, with from about 6 to about 10 bristle bundles arranged in a row across the width of the head, and from about 12 to about 32 of these rows of bundles along the length of the head. A monofilament may be used to make the individual bristles. The monofilaments are grouped together and bent to form bundles of bristles. Typically, there are from about 10 to about 30 monofilaments per bundle. Typically, each bristle has the same diameter, preferably ranging between about 0.004 inch and about 0.010 inch. The length of the bristle typically ranges between about ⅜ inch and about ⅝ inch from the surface of the head. Each monofilament in the bundle is folded approximately in half at about its middle to provide two bristles per monofilament. Usually, there is a staple at the middle of each monofilament bundle which is embedded in the head to attach securely each bundle to the head. Usually, the bristles of each bundle diverge outward from the staple or middle of the bundle.

The third feature is that the head is preferably at an angle with respect to the handle. This is an optional feature. The handle is elongated, having the head bent either to the left or right of the longitudinal axis of the handle. The head may also be bent inward or outward relative to the handle. The angular relationship between the head and the longitudinal axis may range between about 5 and about 15 degrees.

This invention also includes a method of bushing teeth by rubbing the surface of the teeth along the sulcas using a tooth brush having at one end a head to which bristles are attached, a substantial number, preferably essentially all, of these bristles having ends which terminate in a surface that has a helical shape.

DESCRIPTION OF THE DRAWING

The preferred embodiment of this invention, illustrating all its features, will now be discussed in detail. This embodiment depicts the novel and non-obvious tooth brush and method of this invention as shown in the accompanying drawing, which is for illustrative purposes only. This drawing includes the following figures (FIGS.), with like numerals indicating like parts:

FIG. 7*a* is schematic plan view showing the head of the tooth brush making contact with the outside of the user's teeth during brushing.

FIG. 7*b* is a cross-sectional view taken along line 7*b*—7*b* of FIG. 7*a*.

FIG. 7*c* is a cross-sectional view taken along line 7*c*—7*c* of FIG. 7*a*.

FIG. 7*d* is an enlarged fragmentary view showing the tips or ends of the bristles of the tooth brush of this invention engaging the sulcas.

FIG. 8*a* is a plan view of the head of the tooth brush of this invention depicting one arrangement of bristle bundles.

FIG. 8*b* is a plan view of the head of the tooth brush of this invention depicting another arrangement of bristle bundles.

FIG. 8*c* is another plan view of the head of the tooth brush of this invention, with the bristles of the individual bundles being substantially parallel.

FIG. 8*d* is a cross-sectional view taken along line 8*d*—8*d* of FIG. 8*c*.

FIG. 8*e* is a cross-sectional view taken along line 8*e* of FIG. 8*d*.

DETAILED DESCRIPTION OF THE PREFERRED EMBODIMENT

As best shown in FIGS. 1*a*, 1*b*, 2 and 3, the tooth brush 10 of this invention includes an elongated handle 12 having a head 14 at one end joined to the handle 12 by a neck section 16. It is made from conventional materials using well known manufacturing processes.

Figure 1B:
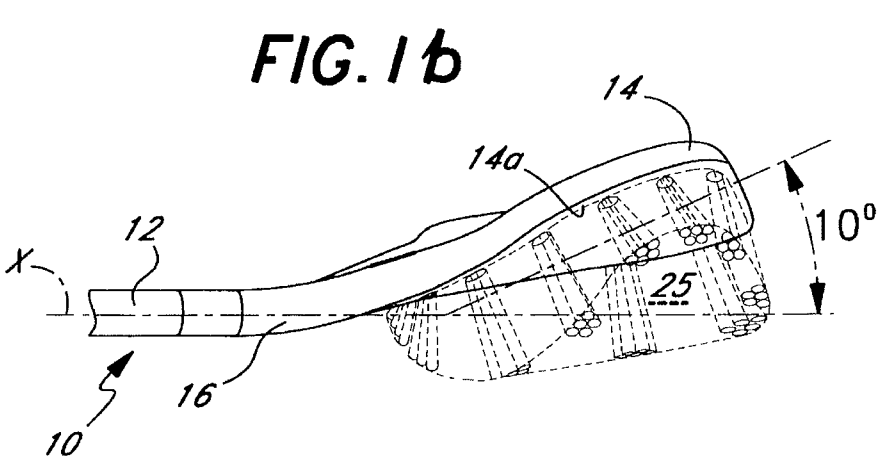
FIG. 1*b* is a side elevational view of the head of the tooth brush of this invention.
Figure 2:
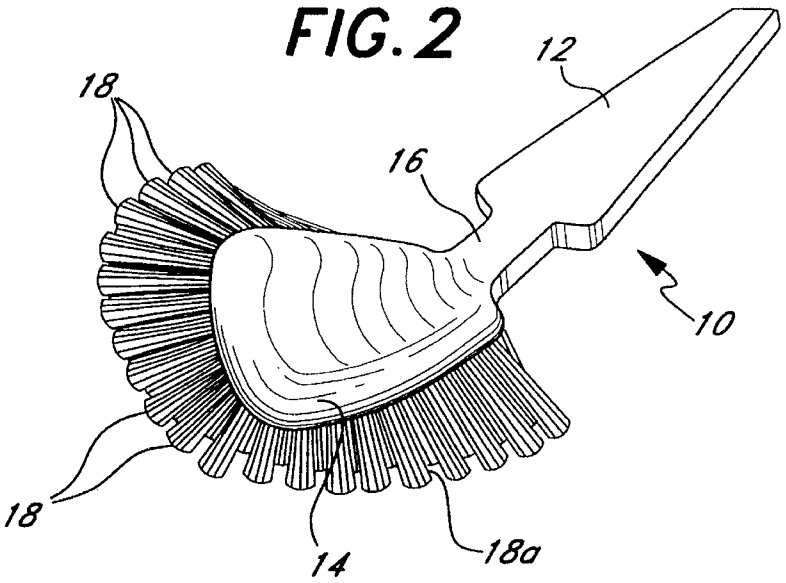
FIG. 2 is a perspective view of the tooth brush of this invention.
Figure 1A:
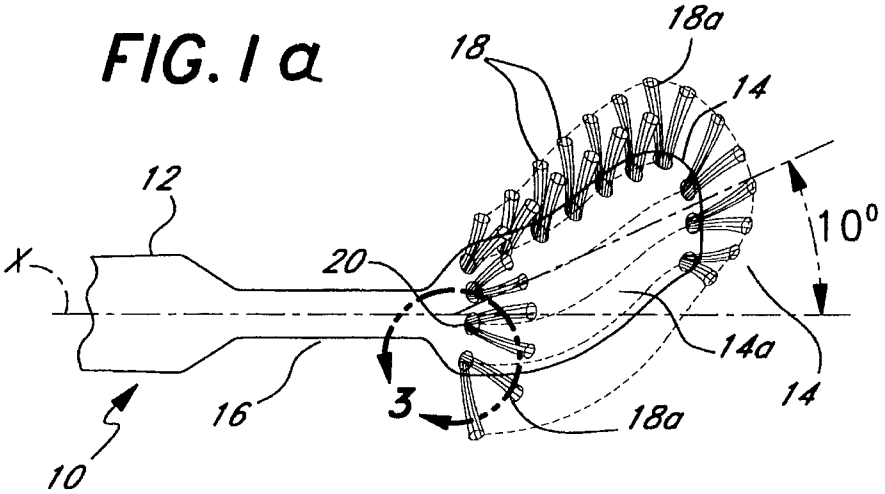
FIG. 1*a* is a plan view of the head of the tooth brush of this invention, with the bristles of each bristle bundle diverging outward from their base.

In accordance with this invention, and as best shown in FIGS. 1*a*, 1*b*, and 2, the head 14 is a generally rectangular planer element twisted into a helical configuration. Preferably, the head is bent relative to the longitudinal axis x of the handle 12. As shown in FIG. 1*b*, the head 14 is bent to the left of the longitudinal axis x at an angle of about 10°, but it could be bent in the opposite direction to the right if desired. As best shown in FIG. 1*b*, the head 14 is also bent outward from the longitudinal axis x at an angle of about 10°, but it could be bent in the opposite direction inward if desired.

Attached to the one side 14*a* of this head 14 are a plurality of bristle bundles 18 lodged in recesses 20 (FIG. 3) in the one side 14*a* of the head 14. The bristle bundles 18 are arranged in rows along the width and length of the head 14. There are four bundles 18 in a row across the width of the head 14 and seven bundles in a row along the length of the head for a total of twenty-eight bristle bundles in the head.

The bundles 18 are made by grouping together straight monofilaments of equal length of about one inch, and then bending or folding the group of monofilaments in half. This provides two bristles 18*a* per monofilament, each about one-half inch in length. Each bundle 18 comprises from about six to about ten monofilaments. The folded end of each bundle of monofilaments is inserted into a recess 20 in the head 14 and a staple 22 is embedded deep within each recess 20 to hold the bundle in place. Preferably, these bristles 18*a* are all approximately of the same length, although the bristles may vary in length if desired. The majority of the bristles, however, will be of equal length and will have ends that lie with a surface 25 that has a helical configuration as best shown in FIGS. 1*a* and 1*b*.

Figure 3:
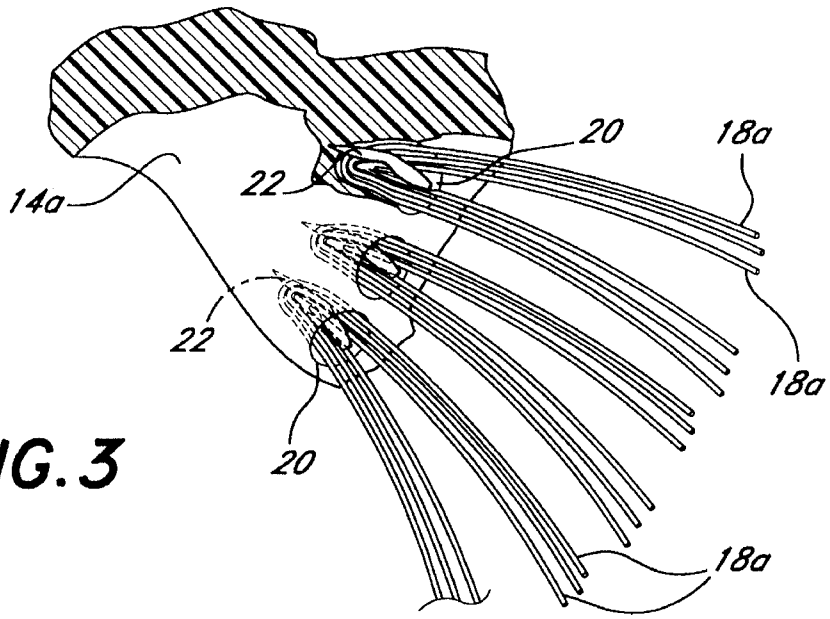
FIG. 3 is an enlarged fragmentary view taken along line 3 of FIG. 1*a*.
Figure 4:
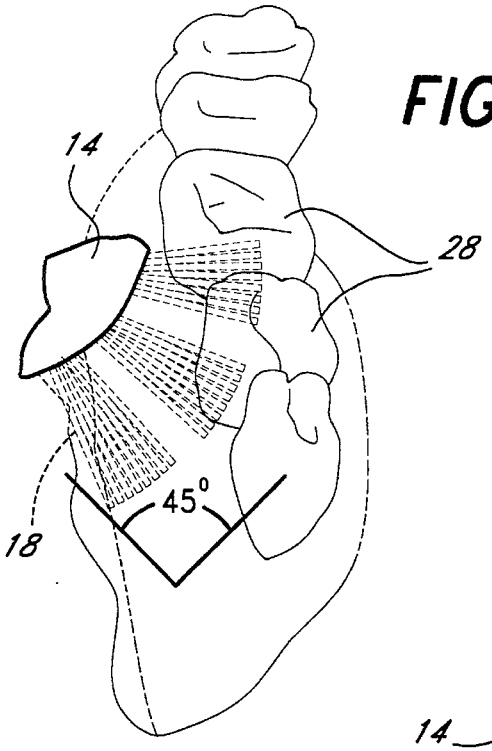
FIG. 4 is a schematic view showing the bristles of the tooth brush shown in FIG. 2 making contact with a user's teeth during brushing.

As depicted in FIGS. 1 through 3, one arrangement of the bristles 18*a* results in the bristles spreading apart, diverging outward from the staple 22. As depicted in FIGS. 8*c* through 8*e*, another arrangement of bristles results in the bristles being substantially parallel. The number and arrangement of the bundles 18 of bristles may vary as shown in FIGS. 8*a* and 8*b*.

Figure 5:
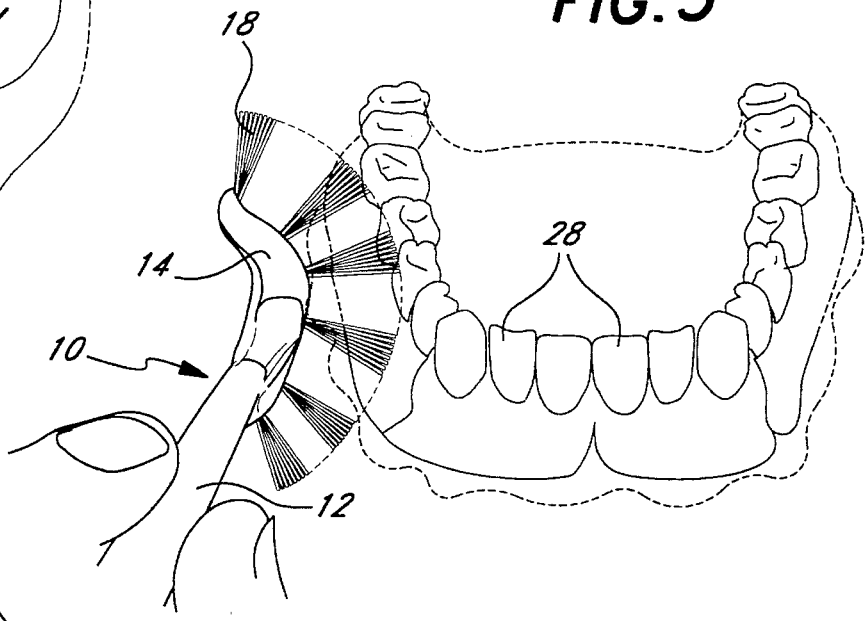
FIG. 5 is another schematic view showing the head of the tooth brush making contact with the outside of the user's teeth during brushing.
Figure 6:
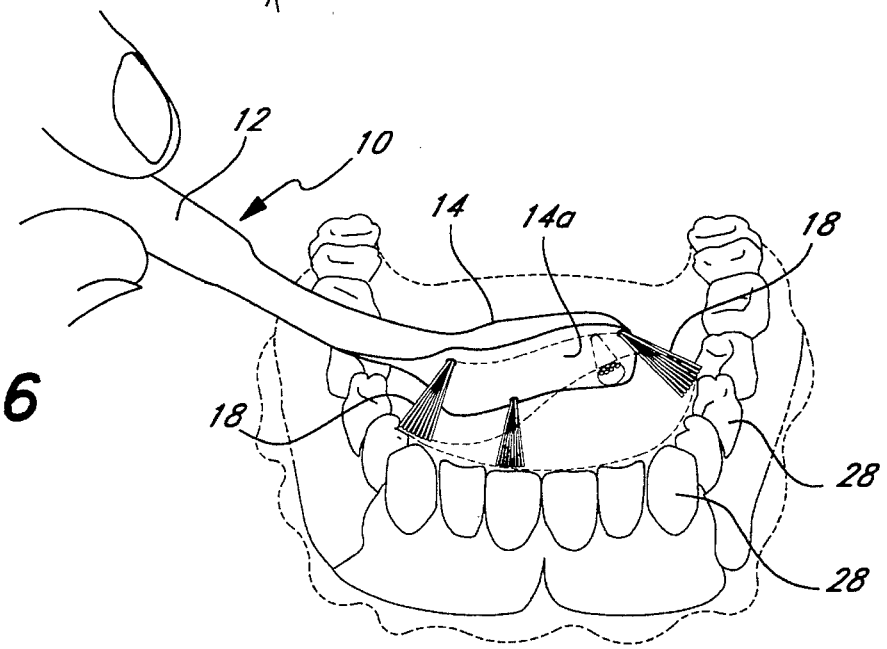
FIG. 6 is another schematic view showing the head of the tooth brush making contact with the inside of the user's teeth during brushing.

As illustrated in FIGS. 7*a* through 7*c*, the user moves the head 14 of the tooth brush 10 across the surface of the teeth 28, a majority, or at least a significant number, of these bristles 18*a* are always at an angular relationship of about 45° with respect to the side surfaces of the teeth 28 essentially no matter what the position of the handle 12. In particular, as the user rubs along the sulcas 30, the tips 18*c* of the bristles sweep material, particularly plaque, from the sulcas, the zone between the gum 32 and base 34 where the crown 36 and the root 38 of a tooth 28*a* meet. This is true when brushing the outside surfaces of the teeth 28 as depicted in FIG. 5 or the inside surfaces of the teeth as depicted in FIG. 6. The unique helical head configuration of this inventions allows at least some of the bristles to come into play and engage the sulcas as depicted essentially regardless of the manner in which the user holds or manipulates the tooth brush 10.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

We claim:

1. A tooth brush including an elongated handle with an elongated head that is sized to fit into the mouth of an individual while this individual is brushing their teeth, said head having a generally rectangular configuration which is twisted into a helical shape and further wherein the head is bent relative to the handle whereby the longitudinal axis of the head defines an acute angle relative to the longitudinal axis of the handle, said head having two sides, with a plurality of bristles extending outward from only one side of the head, said bristles having terminal ends which rub against teeth during brushing, said terminal ends lying along a common surface in the shape of a helix, with a substantial number of said bristles making contact with the teeth at an angle of about 45° during brushing.

2. The tooth brush of claim 1 where substantially all the bristles have approximately the same length.

3. The tooth brush of claim 1 where each bristle is made from a monofilament, said monofilaments being grouped into bundles of from about 10 to about 30 monofilaments per bundle, each bundle being folded approximately in half at about the middle of the bundle to provide two bristles per monofilament.

4. The tooth brush of claim 3 where there are from 100 to 250 bundles in the head.

5. The tooth brush of claim 4 where there are from from 6 to 10 bundles arranged in a row across the width of the head, and from 12 to 32 said rows of bundles along the length of the head.

6. The tooth brush of claim 3 where the bristles of each bundle diverge outward.

7. The tooth brush of claim 3 where the bristles of each bundle diverge outward from the middle of the bundle, and substantially all the bristles are of the same length ranging between ⅜ inch and ⅝ inch, and each bristle has a diameter ranging between 0.004 inch and 0.010 inch.

8. The tooth brush of claim 3 where there is a staple element at the middle of each bundle which is embedded in the head to attach each bundle to the head.

9. A method of bushing the teeth of an individual and removing material from the sulcas of the individual, including the steps of (a) providing a tooth brush including a handle having a head sized to fit into the mouth of the individual while this individual is brushing their teeth, a plurality of bristles extending outward from the head, said bristles having terminal ends which rub against teeth during brushing, said terminal ends lying along a common surface in the shape of a helix, with a substantial number of said bristles making contact with the teeth at an angle of about 45° during brushing, (b) said individual grasping the handle and inserting the head into their mouth, and (b) rubbing the teeth with the terminal ends of the bristles and simultaneously sweeping material from the sulcas with said terminal ends of the bristles, a substantial number of said bristles being always at an angle of about 45° with respect to the side surfaces of the teeth essentially no matter the position of the handle.

10. The method of claim 9 where said head has two sides, with the bristles extending outward from only one side of the head.

11. The method of claim 10 where the head has a generally rectangular configuration which is twisted into a helical shape.

* * * * *